US007541984B2

(12) United States Patent
Peng et al.

(10) Patent No.: US 7,541,984 B2
(45) Date of Patent: Jun. 2, 2009

(54) MULTIPLE FREQUENCY BAND ANTENNA

(75) Inventors: Huang-Tse Peng, Taipei (TW); Kuo-Jen Lai, Taipei (TW)

(73) Assignee: Arima Communications Corporation (TW)

( * ) Notice: Subject to any disclaimer, the term of this patent is extended or adjusted under 35 U.S.C. 154(b) by 34 days.

(21) Appl. No.: 11/878,656

(22) Filed: Jul. 26, 2007

(65) Prior Publication Data

US 2009/0027299 A1 Jan. 29, 2009

(51) Int. Cl.
*H01Q 1/38* (2006.01)

(52) U.S. Cl. ..... 343/700 MS; 343/702

(58) Field of Classification Search ..... None
See application file for complete search history.

(56) References Cited

U.S. PATENT DOCUMENTS 7,057,560 B2 * 6/2006 Erkocevic ..... 343/700 MS
7,119,747 B2 * 10/2006 Lin et al. ..... 343/702
7,358,902 B2 * 4/2008 Erkocevic ..... 343/700 MS
7,375,685 B1 * 5/2008 Nalbandian ..... 343/700 MS
2004/0196187 A1 * 10/2004 Yeh ..... 343/700 MS

* cited by examiner

*Primary Examiner*—Trinh V Dinh
(74) *Attorney, Agent, or Firm*—Bacon & Thomas, PLLC

(57) ABSTRACT

A multiple frequency band antenna is disclosed. The multiple frequency band antenna includes a first radiating element, a second radiating element, a third radiating element, a feeding point and ground. The second radiating element and the third radiating element are connected to the first radiating element and have a path length relatively shorter than that of the first radiating element. The feeding point is connected to the second radiating element. The ground is at least partially connected to the third radiating element and/or the first radiating element. The first radiating element, the second radiating element and the third radiating employ the common feeding point and the ground so that the first radiating element has a first frequency operating band and the second radiating element and the third radiating element have a plurality of second frequency operating bands.

9 Claims, 5 Drawing Sheets

MULTIPLE FREQUENCY BAND ANTENNA

FIELD OF THE INVENTION

The present invention is related to an antenna device, and more particularly to an antenna device for use in a wireless communication device.

BACKGROUND OF THE INVENTION

In recent years, the development of the wireless communication industry is vigorous. The wireless communication devices, for example, cell phones or PDAs, have become an indispensable commodity for people. Antenna devices generally play an important role for transmitting and receiving wireless signals in a wireless communication device. Therefore, the operating characteristics of the antenna device have a direct impact on the transmission and receiving quality for the wireless communication device.

Generally, the antenna device of the portable wireless device is roughly classified into two categories, including the external type antenna and embedded type antenna. The external type antenna is commonly shaped as a helical antenna, and the embedded type antenna is commonly shaped as a planar inverted-F antenna (PIFA). The helical antenna is exposed to the exterior of the casing of the wireless communication device and is prone to be damaged. Thus, the helical antenna usually bears a poor communication quality. A planar inverted-F antenna has a simple structure and a small size and is easily to be integrated with electronic circuits. Nowadays, planar inverted-F antenna has been widely employed in a variety of electronic devices.

Typically, a well-designed antenna device is required to have a low return loss and a high operating bandwidth. In order to allow the user of the wireless communication device to receive wireless signals with great convenience and high quality, the current wireless communication devices have been enhanced by increasing the number of antenna devices or enlarge the antenna device to allow the wireless communication device to transmit and receive wireless signals with a larger bandwidth or multiple frequency bands. However, with the integration of circuit elements and the miniaturization of the wireless communication device, the conventional design method has been outdated.

In order to allow the wireless communication device to increase the number of antenna devices in the limited receiving space so as to transmit and receive wireless signals with a larger bandwidth and a better transmission quality and performance, the structure of the antenna device has been modified. Referring to FIG. 1, the structure of a conventional multiple frequency band antenna is shown. As shown in FIG. 1, the conventional multiple frequency band antenna 1 is made up of a planar inverted-F antenna having a first radiating element 11, a second radiating element 12, and a parasitic element 13. Also, a feeding point 14 and a first ground terminal 15 are disposed at one side of the distal region of the second radiating element 12, and a second ground terminal 16 is disposed at one side of the distal region of the parasitic element 13. The distal region of the first radiating element 11 and the distal region of the second radiating element 12 are connected with each other, and the parasitic element 13 is separated from the first radiating element 11 and the second radiating element 12 and approximate to the first radiating element 11. The multiple frequency band antenna 1 is adapted for dual frequency band applications, where the low frequency band is the frequency band located at 880-960 MHz of the GSM system, and the high frequency band is the frequency band located at 1920-2170 MHz of the WCDMA system.

Referring to FIG. 1 again, the feeding point 14 can feed the RF signals to be transmitted by the RF circuits (not shown) to the multiple frequency band antenna 1. Certainly, the feeding point 14 can feed the RF signal sensed by the multiple frequency band antenna 1 to the RF circuits. The first radiating element 11 is shaped like a right hand square bracket "]" and has a longer path length compared with the second radiating element 12, thereby forming a resonant mode to transmit and receive wireless signals in a low frequency band located at, for example, 880-960 MHz of GSM system. The second radiating element 12 is shaped like the character "L", and the linear segments of the second radiating element 12 that are not connected with the first radiating element 11 are located in the gap between two opposing linear segments of the first radiating element 11. Consequently, the second radiating element 12 has a shorter path length compared with the first radiating element 11, and thus the second radiating element 12 can form a resonant mode to transmit and receive wireless signals in a high frequency band located at, for example, 1920-2170 MHz of the WCDMA system. The parasitic element 13 is configured to increase the bandwidth of the high frequency band.

Referring to FIG. 2, the standing-wave ratio versus frequency relationship of the multiple frequency band antenna of FIG. 1 is shown. As shown in FIG. 2, the longitudinal axis represents the standing-wave ratio (SWR) of the multiple frequency band antenna 1 that shows a linear relationship with the gain value of the return loss. Also, the standing-wave ratio can be converted into the gain value of the return loss through computations. It is to be noted that the standing-wave ratio will vary with the frequency. Generally, if the antenna 1 has a standing-wave ratio below 3 under a frequency band, it indicates that the antenna performs well under that frequency band. Hence, it can be understood from FIG. 2 that the multiple frequency band antenna 1 of FIG. 1 is adapted for the low frequency band located at 880-960 MHz of the GSM system, and for the high-frequency band located at 1920-2170 MHz of the WCDMA system.

In addition to the aforementioned antenna 1, the Taiwanese Patent Application No. 092119341 entitled "multiple frequency band antenna for cell phone" also discloses another antenna structure for use with dual frequency band applications, where the low frequency band is located at the frequency band of the GSM system and the high frequency band is located at the frequency band of personal communication services (PCS) system. However, the contemporary wireless communication system not only supports the GSM system, but also supports the digital communication system (DCS) system, personal communication services (PCS) system, and the WCDMA system. The frequency bands of the DCS system, the frequency bands of the PCS system and the frequency bands of the WCDMA system are located at 1710-1880 MHz, 1850-1990 MHz, and 1920-2170 MHz, respectively. Because conventional antenna is adapted for single frequency band application or dual frequency band applications only, it is obvious that the limited frequency bandwidth of the conventional antenna can not be adapted for the GSM system, the DCS system, the PCS system, and the WCDMA system simultaneously.

Therefore, it is a major concern of the present invention to develop a multiple frequency band antenna with a larger frequency bandwidth for obviating the drawbacks encountered by the prior art.

SUMMARY OF THE INVENTION

An object of the present invention is to provide a multiple frequency band antenna having a plurality of radiating elements, a common feeding point and a common ground terminal for increasing the bandwidth of the antenna. The multiple frequency band antenna according to the present invention is adapted for global system for mobile communication (GSM) system, digital communication system (DCS), personal communication system (PCS), and wideband code division multiple access (WCDMA) system.

Another object of the present invention is to provide a multiple frequency band antenna that can increase its bandwidth without increasing the dimension and size of the antenna, thereby improving the efficiency of antenna and reducing the power consumption of antenna.

To this end, a preferred aspect of the present invention provides a multiple frequency band antenna for a wireless communication device, the multiple frequency band antenna includes a first radiating element, a second radiating element connected to the first radiating element and having a shorter path length compared with the first radiating element, a third radiating element connected to the first radiating element and having a shorter path length compared with the first radiating element, a feeding point connected to the second radiating element, and a ground terminal at least partially connected to the third radiating element and/or the first radiating element. The first radiating element, the second radiating element and the third radiating element share the feeding point and the ground terminal so that the first radiating element is configured to transmit and receive wireless signals with a first frequency band, and the second radiating element and the third radiating element are configured to transmit and receive wireless signals with a plurality of second frequency bands.

Now the foregoing and other features and advantages of the present invention will be best understood through the following descriptions with reference to the accompanying drawings, wherein:

DETAILED DESCRIPTION OF THE PREFERRED EMBODIMENT

A preferred embodiment embodying the features and advantages of the present invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as limitative.

Figure 1:
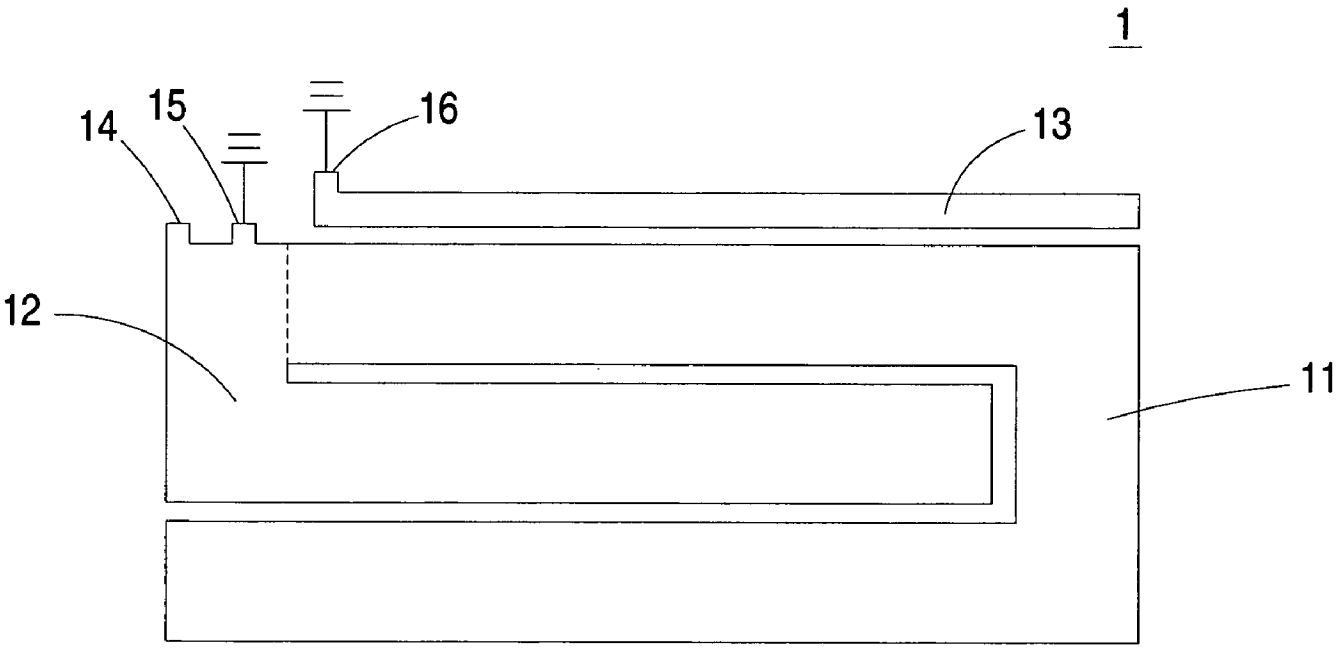
Fig. 1 (PRIOR ART)
FIG. 1 is a plan view showing the structure of a conventional multiple frequency band antenna.
Figure 2:
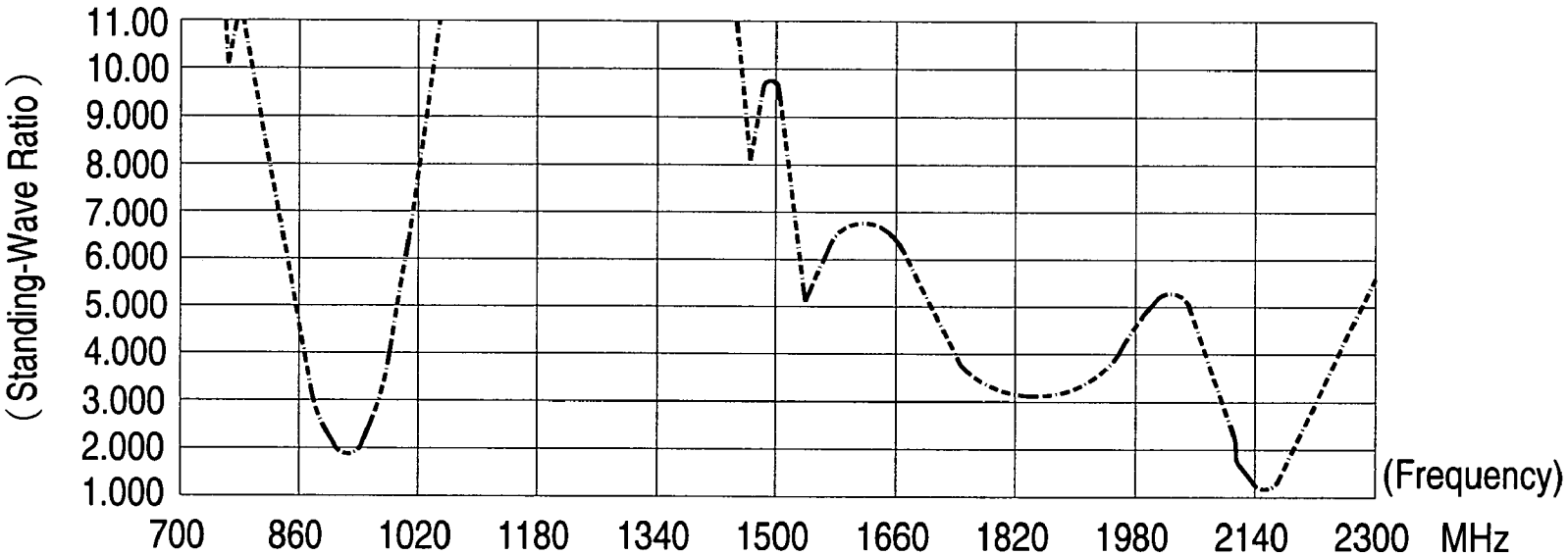
Fig. 2 (PRIOR ART)
FIG. 2 is a characteristic plot showing the standing-wave ratio versus frequency relationship of the multiple frequency band antenna.
Figure 3:
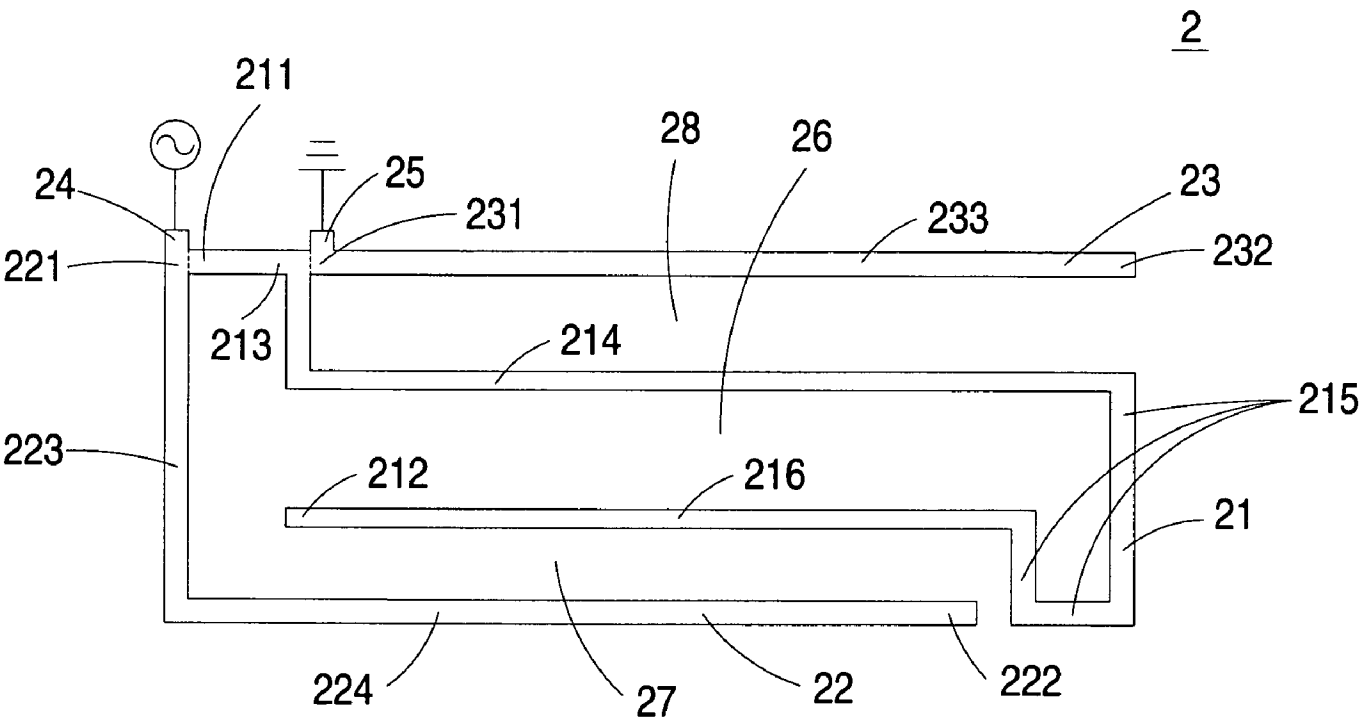
FIG. 3 is a plan view showing the structure of a multiple frequency band antenna according to the present invention.

Referring to FIG. 3, a multiple frequency band antenna according to a preferred embodiment of the present invention is shown. As indicated in FIG. 3, a multiple frequency band antenna 2 according to the present invention is made up of a planar inverted-F antenna device and includes a first radiating element 21, a second radiating element 22, a third radiating element 23, a common feeding point 24 and a common ground terminal 25. The multiple frequency band antenna 2 can be mounted on a flexible printed circuit board (not shown). Owing to the flexibility of the flexible printed circuit board, the multiple frequency band antenna 2 can be securely mounted in the receiving space inside the casing of a wireless communication device without the need of bending the inner wall of the receiving space.

Referring to FIG. 3 again, the first radiating element 21 has a first terminal 211, a second terminal 212, a connecting segment 213, a first linear segment 214, a bent segment 215, and a second linear segment 216. The second radiating element 22 has a first terminal 221, a second terminal 222, a first linear segment 223, and a second linear segment 224. The third radiating element 23 includes a first terminal 231, a second terminal 232, and a linear segment 233. The first terminal 211 of the first radiating element 21 is connected to the first terminal 221 of the second radiating element 22, and the first terminal 231 of the third radiating element 23 is connected to one side of the connecting segment 213 of the first radiating element 21. The connecting segment 213 of the first radiating element 21 is shaped like the upside-down version of the character "L" and connected to the first linear segment 214. The first linear segment 214 and the second linear segment 216 are connected to both ends of the bent segment 215, and are substantially disposed in parallel and separated by a first interval 26. The first linear segment 223 of the second radiating element 22 is connected to the first terminal 221, and the first linear segment 223 and the second linear segment 224 are substantially connected in perpendicular. The second linear segment 224 of the second radiating element 22 is connected between the first linear segment 223 and the second terminal 222, and is substantially disposed in parallel with the second linear segment 216 of the first radiating element 21 and separated by a second interval 27. The linear segment 233 of the third radiating element 23 is disposed between the first terminal 231 and the second terminal 232, and is disposed in parallel with the first linear segment 214 of the first radiating element 21 and separated by a third interval 28.

The feeding point 24 is disposed at one side of the first terminal 221 of the second radiating element 22, and the ground terminal 25 is partially disposed at one side of the first terminal 231 of the third radiating element 23 and/or the connecting segment 213 of the first radiating element 21. The feeding point 24 is configured to feed the RF signal to be transmitted by the RF circuits (not shown) to the multiple frequency band antenna 2. Certainly, the RF signal sensed by the multiple frequency band antenna 2 can be outputted to the RF circuits through the feeding point 24.

The first radiating element 21 has a larger path length compared with the second radiating element 22, thereby forming a resonant mode in the first frequency band (the low frequency band) to transmit and receive wireless signals. The first frequency band can be located at, for example, 880-960 MHz of GSM system. The first terminal 221 of the second radiating element 22 is originated from the feeding point 24, and the first terminal of the third radiating element 23 is originated from the ground terminal 25. Besides, both the second radiating element 22 and the third radiating element 23 are connected with the first radiating element 21 by their terminals. Also, the second linear segment 224 of the second radiating element 22 and the second linear segment 216 of the first radiating element 21 are disposed in parallel. The linear segment 223 of the third radiating element 23 is disposed in parallel with the first linear segment 214 of the first radiating element 21. The second radiating element 22 and the third radiating element 23 have a shorter path length compared with the first radiating element 21, thereby forming different resonant modes in a plurality of second frequency bands to transmit and receive wireless signals. The second frequency bands can be located at, for example, 1710-1880 MHz of DCS system, 1850-1990 MHz of PCS system and 1920-2170 MHz of WCDMA system.

Figure 4:
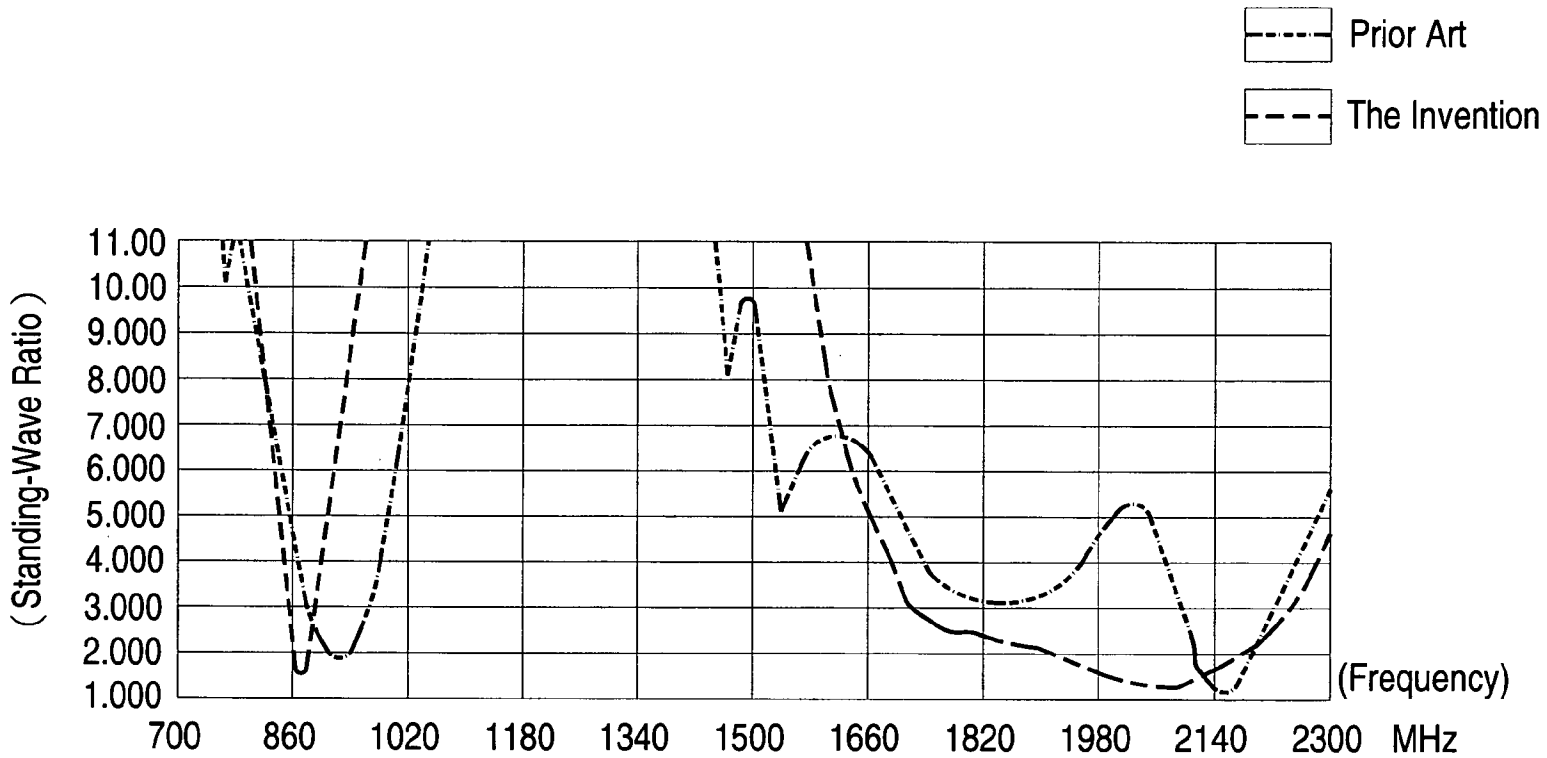
FIG. 4 is a compilation showing the comparison between the standing-wave ratio versus the frequency relationship of the multiple frequency band antenna of FIG. 1 and the standing-wave ratio versus the frequency relationship of the multiple frequency band antenna of FIG. 3.

Referring to FIG. 4, the comparison between the standing-wave ratio versus frequency relationship of the multiple frequency band antenna of the present invention and the standing-wave ratio versus frequency relationship of the conventional multiple frequency band antenna is depicted. As shown in FIG. 4, the longitude axis represents the standing-wave ratio of the multiple frequency band antenna that shows a linear relationship with the gain value of the return loss and can be converted into the gain value of the return loss through computations. It is to be noted that the standing-wave ratio will vary with the frequency. Generally, if the antenna has a standing-wave ratio below 3 under a frequency band, it indicates that the antenna performs well under that frequency band. Hence, it can be understood from FIG. 4 that the conventional antenna device 1 is adapted for dual frequency band application where the low frequency band is located at 880-960 MHz of GSM system and the high frequency band is located at 1920-2170 MHz of WCDMA system. However, the multiple frequency band antenna of the present invention can increase the bandwidth of the high frequency band so that it can be adapted for DCS system, PCS system, and WCDMA system.

Figure 5:
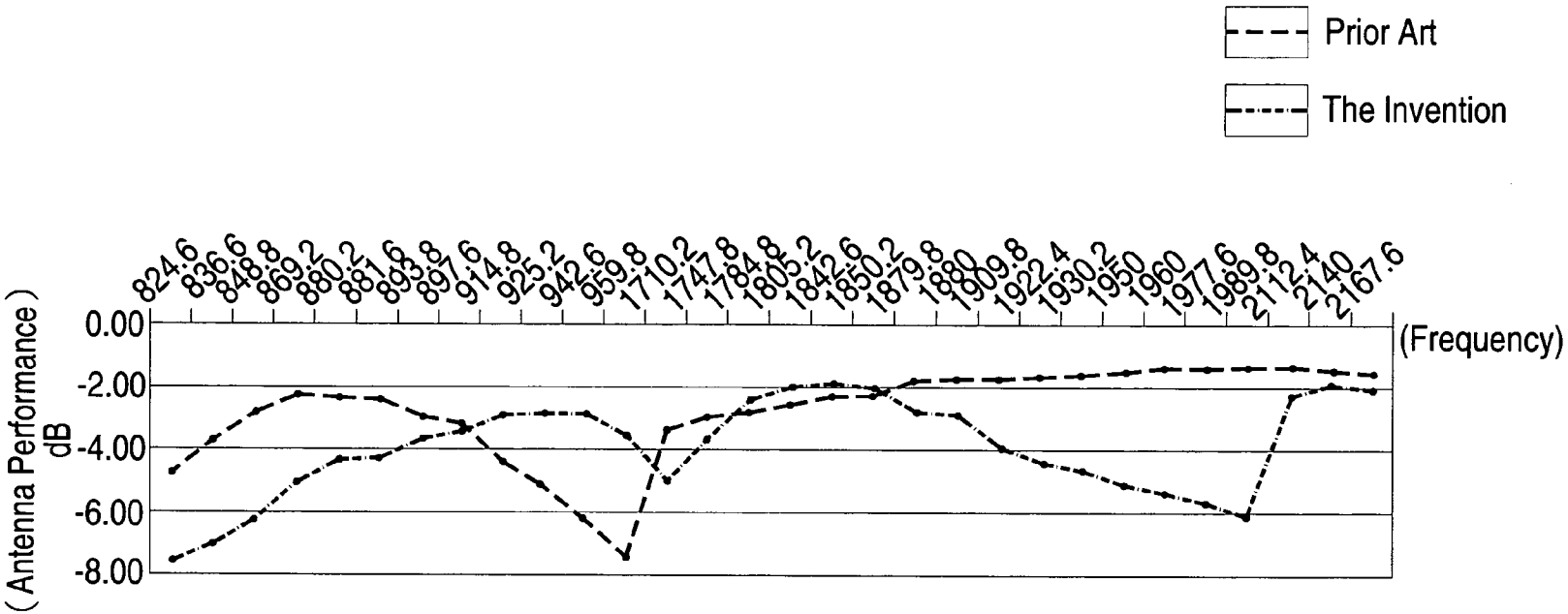
FIG. 5 is a compilation showing the comparison between the performance versus the frequency relationship of the multiple frequency band antenna of FIG. 1 and the performance versus the frequency relationship of the multiple frequency band antenna of FIG. 3.

Referring to FIG. 5, the comparison between the antenna performance versus frequency relationship of the multiple frequency band antenna of the present invention and the antenna performance versus frequency relationship of the conventional multiple frequency band antenna is depicted. As shown in FIG. 5, in the low frequency band located at 880-960 MHz of GSM system, the multiple frequency band antenna 2 of the present invention has a comparable performance with the conventional multiple frequency band antenna 1. However, in the high frequency band located at the frequency band of DCS system, the frequency band of PCS system, or the frequency band of WCDMA system, the multiple frequency band antenna 2 of the present invention can attain a better performance and lower power consumption compared with the conventional multiple frequency band antenna 1.

Table 1 shows the comparison between the conventional multiple frequency band antenna and the multiple frequency band antenna of the present invention in terms of performance and physical characteristics. It can be understood from table 1 that the multiple frequency band antenna 2 of the present invention has a larger bandwidth at the high frequency band area. Hence, the multiple frequency band antenna of the present invention can attain a good performance in the frequency band of DCS system, the frequency band of PCS system, and the frequency band of WCDMA system. The performance of the multiple frequency band antenna of the present invention is incomparable with the performance of the conventional multiple frequency band antenna. Besides, the dimension and size of the multiple frequency band antenna 2 of the present invention are substantially the same with those of the conventional multiple frequency band antenna. Thus, the multiple frequency band antenna of the present invention does not hinder the miniaturization of the wireless communication device. Also, conventional multiple frequency band antenna requires one or more feeding points and two or more ground terminals. However, the multiple frequency band antenna of the present invention only requires a common feeding point and a common ground terminal, thereby simplifying the structure of the antenna.

TABLE 1

The performance and physical characteristic of the conventional multiple frequency band antenna and the multiple frequency band antenna of the present invention

| | Performance | | | | Physical Characteristics | |
|---|---|---|---|---|---|---|
| | GSM | DCS | PCS | WCDMA | Dimension | Joints |
| Prior Art | Good | Poor | Poor | Fair | The same | 3 |
| The present invention | Good | Good | Good | Good | The same | 2 |

In conclusion, the present invention provides a multiple frequency band antenna by configuring and connecting a plurality of radiating elements and a common feeding point and a common ground terminal, so as to increase the bandwidth of the antenna. Thus, the multiple frequency band antenna of the present invention can be applied to GSM system, DCS system, PCS system, WCDMA system simultaneously. On the other hand, the multiple frequency band antenna of the present invention can increase the bandwidth of the antenna, improve the antenna efficiency, reduce the power consumption of the antenna without increasing the dimension and size of the antenna.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A multiple frequency band antenna for a wireless communication device comprising:

a first radiating element including a first terminal, a second terminal, a connecting segment, a first linear segment, a bent segment, and a second linear segment;

a second radiating element connected to the first radiating element and having a shorter path length compared with the first radiating element, the second radiating element including a first terminal, a second terminal, a first linear segment, and a second linear segment;

a third radiating element connected to the first radiating element and having a shorter path length compared with the first radiating element, the third radiating element including a first terminal, a second terminal, and a linear segment;

a feeding point connected to the second radiating element; and a ground terminal connected to the third radiating element and/or the first radiating element;

wherein the first radiating element, the second radiating element and the third radiating element share the feeding point and the ground terminal, the first radiating element is configured to transmit and receive wireless signals in a first frequency band; and the second radiating element and the third radiating element are configured to transmit and receive wireless signals in a plurality of second frequency bands.

2. The multiple frequency band antenna according to claim 1 wherein the first frequency band is the frequency band of the global system for mobile communications.

3. The multiple frequency band antenna according to claim 1 wherein the plurality of second frequency bands include the frequency band of the digital communication system, the frequency band of the personal communication services, and the frequency band of the wideband code division multiple access.

4. The multiple frequency band antenna according to claim 1 wherein the multiple frequency band antenna is mounted on a flexible printed circuit board.

5. The multiple frequency band antenna according to claim 1 wherein the first terminal of the first radiating element is connected to the first terminal of the second radiating element, and the first terminal of the third radiating element is connected to one side of the connecting segment of the second radiating element.

6. The multiple frequency band antenna according to claim 1 wherein the first linear segment and the second linear segment of the first radiating element are connected to both ends of the bent segment, and the first linear segment and the second linear segment of the first radiating element are substantially disposed in parallel and separated by a first interval.

7. The multiple frequency band antenna according to claim 6 wherein the first linear segment and the second linear segment of the second radiating element are substantially connected in perpendicular, and the second linear segment of the second radiating element and the second linear segment of the first radiating element are substantially disposed in parallel and separated by a second interval.

8. The multiple frequency band antenna according to claim 7 wherein the linear segment of the third radiating element and the first linear segment of the first radiating element are substantially disposed in parallel and separated by a third interval.

9. The multiple frequency band antenna according to claim 1 wherein the feeding point is disposed at one side of the first terminal of the second radiating element, and the ground terminal is disposed at one side of the first terminal of the third radiating element.

* * * * *